United States Patent [19]

Las

[11] 4,234,187

[45] Nov. 18, 1980

[54] DEVICE FOR MARKING AN ELEMENT OF INFORMATION

[76] Inventor: Roger Las, 1145 Les Poissons, 92400 Courbevoie, France

[21] Appl. No.: 921,112

[22] Filed: Jun. 30, 1978

[30] Foreign Application Priority Data

Jul. 8, 1977 [FR] France ..... 77 21208
Dec. 5, 1977 [FR] France ..... 77 36566

[51] Int. Cl.[3] ..... A63F 3/00; A63F 9/00

[52] U.S. Cl. ..... 273/248; 273/281; 273/145 C; 40/493

[58] Field of Search ..... 40/111, 110, 493; 273/280, 281, 144 B, 145 C, 248, 282; 35/77; 116/DIG. 34, 223; 73/761

[56] References Cited

U.S. PATENT DOCUMENTS

| | | | |
|---|---|---|---|
| 441,067 | 11/1890 | Henderson | 40/111 |
| 1,538,455 | 5/1925 | Winkel | 273/145 C |
| 2,110,668 | 3/1938 | Janssen | 40/111 |
| 3,365,819 | 1/1968 | Connell | 35/77 |
| 3,365,820 | 1/1968 | Connell | 40/493 |
| 3,423,872 | 1/1969 | Dodson | 273/144 B |
| 3,579,854 | 5/1971 | Tusson | 35/77 X |

FOREIGN PATENT DOCUMENTS

| | | | |
|---|---|---|---|
| 653079 | 5/1951 | United Kingdom | 40/111 |

*Primary Examiner*—Richard C. Pinkham
*Assistant Examiner*—Scott L. Brown
*Attorney, Agent, or Firm*—Cushman, Darby & Cushman

[57] ABSTRACT

The device includes an helical thread cylinder, a sequence of elements of information being placed between said helical threads.

A ring cooperating with the helical threads in the same way as a nut is fitted with a window, through which a selected element of information appears. Such a device can be used in games of snakes and ladders type.

7 Claims, 5 Drawing Figures

DEVICE FOR MARKING AN ELEMENT OF INFORMATION

FIELD OF THE INVENTION

The invention relates to a device for marking an element of information among various sequential elements of information and more particularly the application of such a device to the field of games of chance.

BACKGROUND OF THE INVENTION

There are many practical examples where a piece of information should be marked among a set of information. Such examples include for instance:

In a calendar, one often wishes to mark the exact date. To this end, calendars have been provided wherein figures 1-31 are written on a metal plate and a magnetic material disk can be placed to surround a date to mark it. Similarly, calendars have been provided with means allowing a mark to slide in front of successive figures forming a linear scale.

Various devices have also been devised, wherein sequential figures are arranged on the periphery of a disk, an additional disk or a coaxial pointer acting as a mark opposite one of the figures printed on said periphery.

Various devices incorporating a window have also been devised, which comprise several planes sliding linearly, or disks, for instance of the well-known "parking-disk" type, where an initial time appears through a first window, a second window showing a final time.

In numerous games, such as the game of snakes and ladders, successive squares are provided in such a way that they form various track arrangements on a reference plane. Players push small pieces of plastic or the like (which shall be referred to here as "counters") forwardly on the tracks by following various pre-determined rules, for instance, according to the indications given by dice.

The games of the prior art are suffering from the drawback that the dice or the like roll outside the surface on which they are thrown, and that the dice may be lost, and in any case recovering said dice is drudgery. In order to overcome this drawback, the tracks of the prior art games include flanges which limit the risk of the dice falling from said tracks, yet without eliminating it. But another drawback of such track devices is that their surface is necessarily substantially large, unless the game elements are of an inconveniently small size. Therefore, such devices of the prior art are not particularly suitable to be used as journey games.

SUMMARY OF THE INVENTION

It is an object of this invention to provide a new device for marking an element of information amongst a plurality of sequential elements, said device having a new and more compact shape, wherein marking means and information support means are mechanically linked in order to avoid loosing any one of said elements.

It is another object of this invention to provide a new type of games of chance, wherein figure appearing on die faces is dealt with and which overcomes the drawbacks of the devices of the prior art.

It is another object of this invention to provide a game of the above mentioned type which has a small size.

It is another object of this invention to provide a game of the above mentioned type which is simple and cheap to manufacture.

The device of the present invention which allows one element of information to be marked amongst a plurality of sequential elements includes: a cylinder, at the periphery of which the elements to be displayed form an helical sequence having a given pitch, said cylinder being fitted with helical thread means of the same pitch; and a ring mounted on said cylinder, having means to cooperate with said thread means, including a window having substantially the same size as each of the elements to be displayed or marked. In such an arrangement, rotating said ring around the cylinder results in said ring moving along the cylinder axis, the window being helically moved and the elements to be marked or displayed, becoming sequentially visible in said window.

According to another aspect of this invention, said cylinder acts as a closed box including a fluid and having at least a transparent wall, at least one element with a specific gravity lower than that of said fluid being freely immerged in said fluid so that it can be flush with the upper part of the enclosure wall.

BRIEF DESCRIPTION OF THE DRAWINGS

The novel features which are believed to be characteristic of the present invention are set forth with particularity in the appending claims. The invention, together with further objects and advantages thereof, can best be understood with reference to the following description taken in connection with the accompanying drawings, in which:

DETAILED DESCRIPTION OF THE INVENTION

Figure 1A:
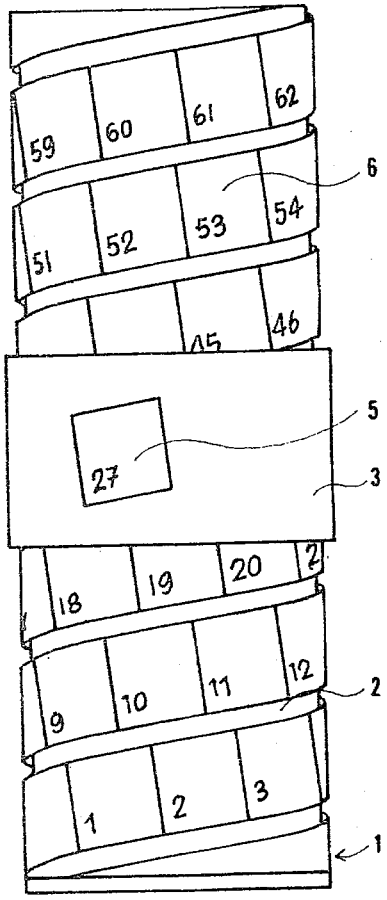
FIG. 1*a* is a view showing an embodiment of the device of the present invention.
Figure 1B:
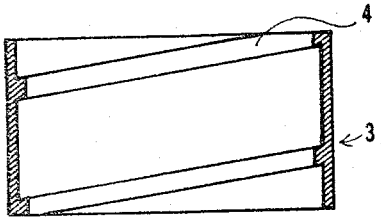
FIG. 1*b* is a sectional view showing the ring of the device of this invention.

Referring to FIG. 1*a*, there is shown a device including a cylindrical body having either a recessed or a projecting thread 2, and a ring 3, the internal surface of which includes a thread 4 (as best seen in FIG. 1*b*), conjugated with the thread 2 of cylinder 1. Therefore, the ring 3 moves in relation to cylinder 1 in the same way as a nut on a screw. The ring 3 includes a window 5 which allows the underlying part of the cylinder 1 to be seen.

Between the successive threads 2, there is placed square 6 containing the elements of information which are to be sequentially seen through the window 5. The elements of information contained inside the squares 6 can correspond to those displayed, for instance by calendars, game squares, or to any other suitable information.

Should the device of the present invention be used as a calendar, a three stage device could be provided, each stage being of the type shown in FIG. 1*a*, one stage carrying the months, another stage the days and the last stage the date of the month.

Should the device of the present invention be used as a game of the snakes and ladders type, each player will be provided with such a device, the squares thereof containing the patterns usual to such games. Each player will turn the ring in order to move the window forwardly, by a number of squares corresponding, for instance, to the figures obtained with the dice used. It will be noticed that, when used as a game of the snakes and ladders type, the device of this invention offers the advantage to provide a game which can be easily played during a journey, for instance during a car ride. As a matter of fact, when using a conventional type game where counters are moved on the top of a plane plate, any braking action or sudden movement of the car may result in the counters being displaced, falling or even being lost. Such a drawback is overcome with the game of the present invention.

In order to ensure a better positioning of the window in relation with the various squares, pawl or groove means conjugated with mated grooves or embossings can be provided between the cylinder squares.

Cylinder 1 can be fitted with a bottom and a cover in order to form a box and simultaneously to prevent ring 3 from being removed from said cylinder. Of course, the so made box can be filled with a liquid, i.e. used as a bottle.

Figure 2:
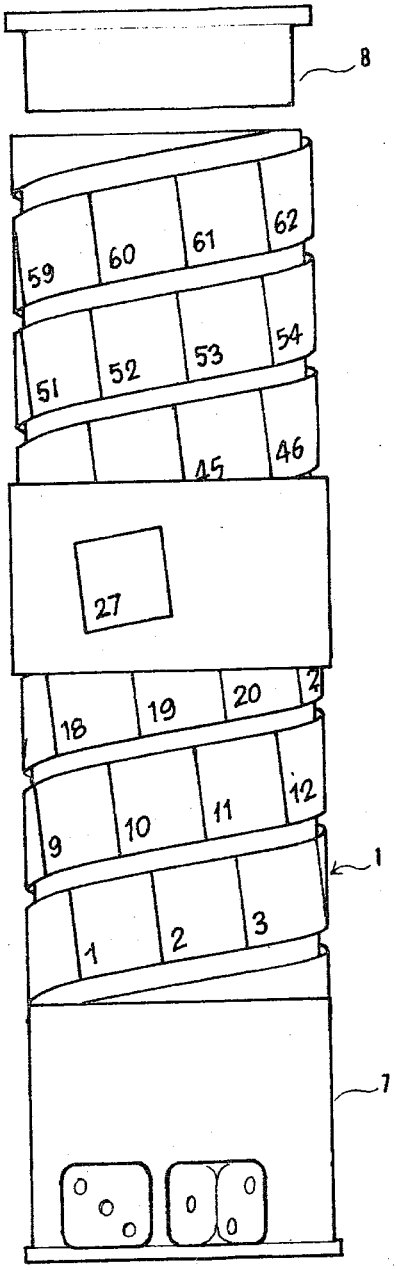
FIG. 2 is a view showing another embodiment of this invention.

Referring to FIG. 2, there is shown an embodiment of such a box. The cylinder includes a bottom 7 which is an extension of the portion carrying the squares, said bottom being made of a transparent material, and a cover 8 closing the upper part of said cylinder.

An individual game is consequently obtained in which the indication carried by the dice can be read through the transparent wall of bottom 7. This game solves the drawbacks of the games of snakes and ladders of the prior art, as there is no risk to loose either the counters which are replaced by the sliding ring, or the dice which are enclosed within the cylinder. Of course, each player will have a device such as the one shown in FIG. 2. The cylinder assembly is possibly made of transparent plastic material, the indications corresponding to the squares of the game being marked, for instance, on a ribbon placed over this plastic material and fixed thereon by an adhesive, by thermowelding or any other means well-known to those skilled in the art.

Figure 3:
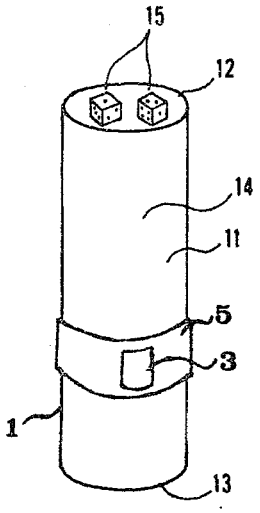
FIG. 3 is a view showing another embodiment of this invention.

Referring to FIG. 3, there is shown another embodiment of the invention, wherein cylinder 1 bearing the ring 3 forms a closed cylindrical enclosure including a cylindrical side wall 11, an upper wall 12, and a lower wall 13. The inside of this enclosure is filled with a liquid 14, preferably up to the top of the enclosure. Said enclosure includes various elements 15 having a specific gravity lower than that of the liquid 14, so that they always are flush with the upper wall thereof, no matter is the position of said enclosure. In the embodiment shown, elements 15 are dice.

In another embodiment of the invention, only the wall 12 is transparent whilst the other ones are opaque. So, the cylinder being initially placed so that opaque wall 13 thereof is directed upwardly, once said cylinder is put upside down, the dice 15 are raised, being subject to substantially random rotation or whirling, and engage the transparent upper wall 12, with the result that figures or any pattern marked on the die face which is applied to the wall 12 can be seen. This is of great help to the user who has not to lean in order to see the way the dice are thrown on a surface, but on the contrary, who sees the dice coming towards him. According to another embodiment of the invention, both opposite walls 12 and 13 of the cylinder are transparent with the result that after having turned the cylinder upside down, a new combination of figures can be seen on the dice.

The transparent walls 12,13 of the device of the present invention will possibly act as a lens, by having, for instance, a plane internal surface in contact with the liquid and a convex external surface in order to obtain a magnification which helps in reading the die face applied to this surface, whereby the game structure of the present invention can be further reduced. Fresnel type lenses can also be provided.

According to one important aspect of this invention, the above described marking device can be made of various materials. For instance, the cylinder and the ring are possibly made of plastic material, the cylinder of a translucent material as already described, the ring of a translucent material in order to make the squares adjacent to those which should be identified appear, the identified square being outlined, for instance, by a frame, an open window, a different colour or any other similar means.

The cylinder can also be made of stamped metal. Or else, the cylinder and the ring can be made of cardboard, the helical track being stuck on a cardboard cylinder and said track being assembled so that a groove forms an helical thread. In this embodiment, a device particularly cheap can be obtained, which can be used, for instance, as an advertising medium. In fact, the cylinder of this invention can be considered as a box for any desirable product, for instance, sweets, pencils, pills, and so on. In the particular case where the box encloses pills to be taken periodically without exceeding a given quantity, the window could be moved forwardly by one step whenever a pill is taken, with the result that the number of already taken pills could be easily counted.

Many other applications of the device of the present invention can also be contemplated. For instance, a ring fitted with several windows can be used as a "parking disk". The single window device can be used by itself to display the number of miles during a journey. For instance, the various exits of a motorway can be indicated on the successive squares and the passenger will be able to turn the successive squares thereof in order to determine the distance still to be covered up to the motorway exit.

In the foregoing description, the device of the present invention has been considered as a self-content instrument. It will be noted that, owing to its cylindrical shape, said device can be adapted to or incorporated in any pre-existing cylindrical element. For instance, when used as a calendar, the device of this invention can be mounted on, or incorporated in, the cylindrical base of a reading lamp. Similarly, when used as a parking disk, the device of this invention can be integrated to a cylindrical element inside a car, for instance, the driving mirror support. Of course, the foregoing indications are only given as examples and should not limit the scope of the invention. As already described, ring 3 can be made of transparent material to allow the user to see the squares adjacent to the marked one. On the contrary, as far as other games or other applications are concerned, it may be advantageous to make only the desired square appear, all the remaining squares marked on the cylinder being masked. The embodiment of FIG. 4 meets this requirement. As in the embodiment of FIG.

Figure 4:
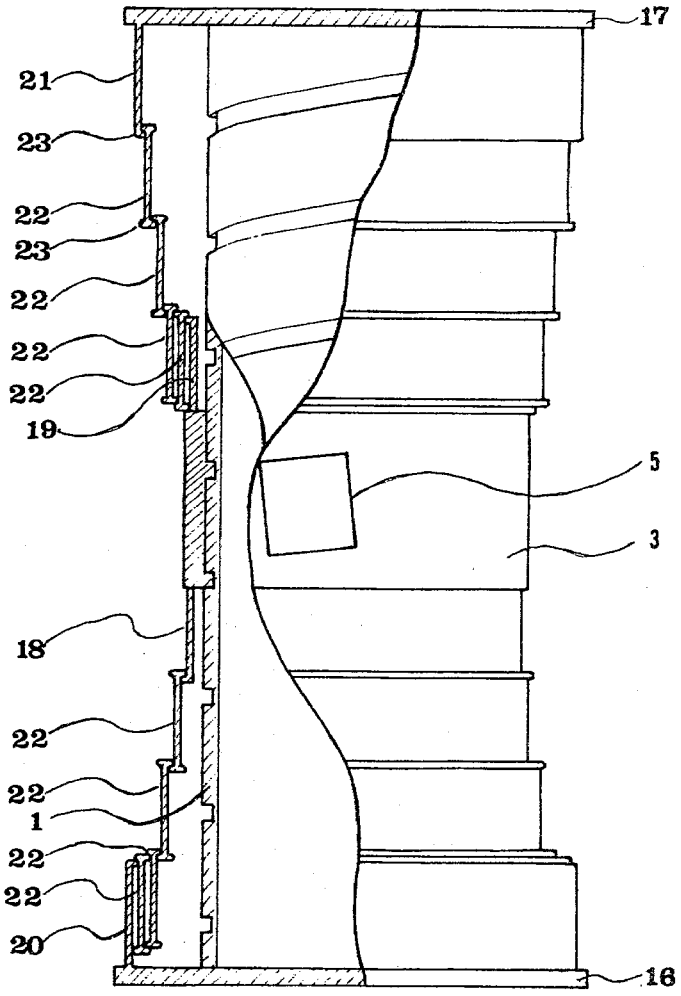
FIG. 4 is a view showing another embodiment of this invention.

1a, ring 3 is linked to cylinder 1 by means of threads. Successive telescoping rings are placed between plates 16 and 17 integral with the cylinder ends. So, when the window ring 3 goes up and down, the other rings mask the cylinder 1. In the embodiment of FIG. 4, first rings 18 and 19 are integral with the window ring 3 and rings 20 and 21 are integral with the end plates 16 and 17. Intermediate rings 22 are fitted with flanges 23 which prevent said rings from escaping. Said device can be made according to processes well-known to those skilled in the art, and, for instance, can be press-fitted. In the embodiment of FIG. 4, as well as in that of FIG. 1a, positioning means can be provided, which may be of the pawl type, in order to correctly position window 5 in front of a conjugated square on the cylinder.

There has been described what is at present considered to be the preferred embodiments of the invention; it will be understood that various modifications may be made therein, and it is intended to cover in the appended claims all such modifications as fall within the true spirit and scope of the invention.

What we claim is:

1. A marking device to mark an element of information out of a plurality of sequential elements, said device comprising:

a cylinder at the periphery of which are placed in successive squares, according to a helical sequence of a given pitch, the elements to be marked, said cylinder being fitted with helical thread means of the same pitch, a ring on said cylinder having means to cooperate with said thread means and comprising at least one window having substantially the same dimensions as each of said elements to be marked, said cylinder being made from a smooth cylinder, substantially thick strips carrying the information to be marked being helically stuck on said smooth cylinder in such a way as to provide a groove forming said helical threads, whereby, by rotating said ring around said cylinder, said elements to be marked sequentially appear in said window.

2. The device as set forth in claim 1, wherein said cylinder and said ring are provided with elements able to cooperate in order to accurately position the window on the successive squares.

3. The device as set forth in claim 1, wherein said means to cooperate include a second threading complementary to said thread means.

4. A marking device to mark an element of information out of a plurality of sequential elements, said device comprising:

a cylinder at the periphery of which are placed in successive squares according to a helical sequence of a given pitch the elements to be marked, said cylinder being fitted with helical thread means of the same pitch, a ring fitted on said cylinder having means to cooperate with said thread means and comprising at least one window having substantially the same dimensions as each of said elements to be marked; whereby, by rotating said ring around said cylinder, said elements to be marked sequentially appear in said window, further including two telescopically sliding sets of rings, the end rings of each set of rings being fixed on one hand to an end portion of said cylinder, on the other hand to the window ring, whereby all cylinder portions except the one appearing throuh said window are masked.

5. A marking device to mark an element of information out of a plurality of sequential elements, said device comprising:

a cylinder at the periphery of which are placed in successive squares, according to a helical sequence of a given pitch, the elements to be marked, said cylinder being fitted with helical thread means of the same pitch, and including bottom means and cover means in order to form a closed box, a ring fitted on said cylinder having means to cooperate with said thread means and comprising at least one window having substantially the same dimensions as each of said elements to be marked; whereby, by rotating said ring around said cylinder, said elements to be marked sequentially appear in said window, said cylinder having an end portion forming part of said closed box and extending axially beyond helical sequence, at least part of said end portion of said cylinder being made of a translucent material, and at least one individual information-carrying element being freely received within said closed box, whereby in at least a position of said device said information-carrying element may be seen from the outside.

6. The device set forth in claim 5, wherein at least said cover means is made of a translucent material, said closed box being filled with a liquid, said information-carrying element being made of a material having a density lower than that of said liquid and being immersed therein, whereby, the device being positioned with said cover means directed upwardly, at least a portion of said element may be seen through said cover means.

7. The device set forth in claim 5, wherein said information-carrying element is a die.

* * * * *